US005483720A

United States Patent [19]

Decoopman et al.

[11] Patent Number: 5,483,720

[45] Date of Patent: Jan. 16, 1996

[54] SPONGE MOP

[75] Inventors: Carl Decoopman, Ingelmunster, Belgium; Bryan Johnson, Beauvais, France

[73] Assignees: Financiere Elysees Balzac, Paris, France; P.D.C. Brush N.V., Izegem, Belgium

[21] Appl. No.: 267,979

[22] Filed: Jun. 29, 1994

[30] Foreign Application Priority Data

Jun. 29, 1993 [FR] France ..... 93 07890

[51] Int. Cl.[6] ..... A47L 13/146

[52] U.S. Cl. ..... 15/119.2; 15/118; 15/144.1; 15/145; 15/147.2; 15/229.11; 15/244.1; 15/244.2; 15/244.3

[58] Field of Search ..... 15/116.2, 118, 15/119.2, 144.1, 145, 147.1, 147.2, 209.1, 228, 229.11, 229.13, 230.17, 231, 232, 244.1–244.3

[56] References Cited

U.S. PATENT DOCUMENTS

| | | | |
|---|---|---|---|
| 3,031,705 | 5/1962 | Herman et al. | 15/244.1 |
| 3,214,779 | 11/1965 | Wheeler | 15/244.2 |
| 3,295,155 | 1/1967 | Belsky et al. | 15/228 |
| 3,355,844 | 12/1967 | Abler et al. . | |
| 3,590,414 | 7/1971 | Gores | 15/244.1 |
| 3,684,325 | 8/1972 | Okun | 15/231 |
| 3,791,330 | 2/1974 | Haddad | 15/244.1 |
| 3,792,505 | 2/1974 | Saltzstein | 15/231 |
| 3,806,982 | 4/1974 | Park | 15/244.1 |
| 4,455,705 | 6/1984 | Graham | 15/244.2 |
| 4,580,307 | 4/1986 | Moss | 15/228 |
| 4,799,283 | 1/1989 | Haydon | 15/228 |
| 4,852,210 | 8/1989 | Krajicek | 15/228 |
| 4,928,341 | 5/1990 | Pacione | 15/119.2 |

FOREIGN PATENT DOCUMENTS

| | | |
|---|---|---|
| 407789 | 11/1968 | Australia . |
| 600603 | 4/1989 | Australia . |
| 0494021 | 7/1992 | European Pat. Off. . |
| 4008716 | 6/1991 | Germany . |

*Primary Examiner*—Mark Spisich
*Attorney, Agent, or Firm*—Dvorak and Traub

[57] ABSTRACT

A sponge mop including a mount connected to a handle, the mount including at least one elongate support element designed to receive a spongy layer. The spongy layer is fixed to the support by a releasable fixing element including at least two fixing slides secured to the support, and at least one hooking slab secured to the spongy layer and designed to co-operate with the fixing slides. The slides are slidably mounted in slideway-forming element. The sponge mop also includes two lateral wings that are pivotally mounted and capable of being moved by a control element between a mopping position and a wringing-out position. A socket device may be provided for connecting the handle to the mount.

27 Claims, 8 Drawing Sheets

FIG. 11
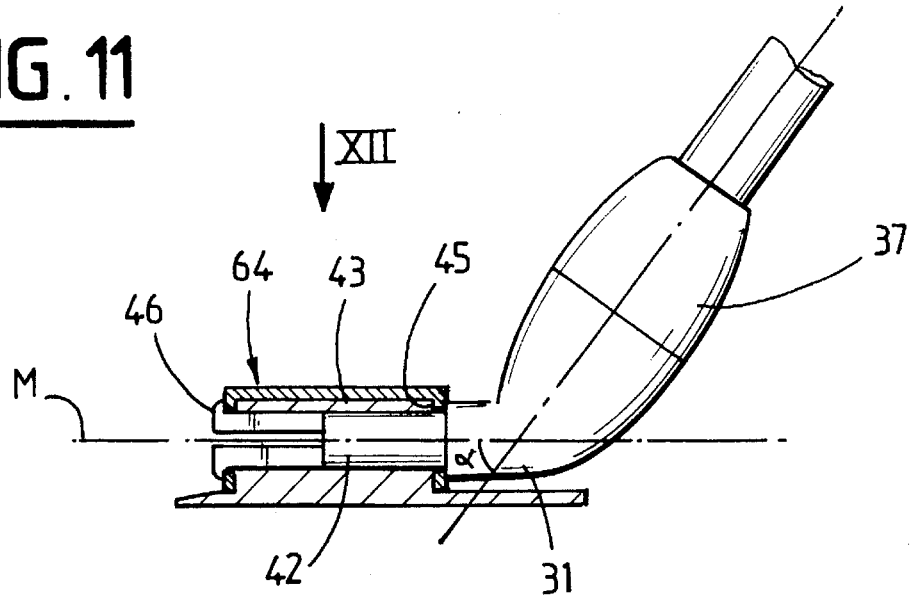
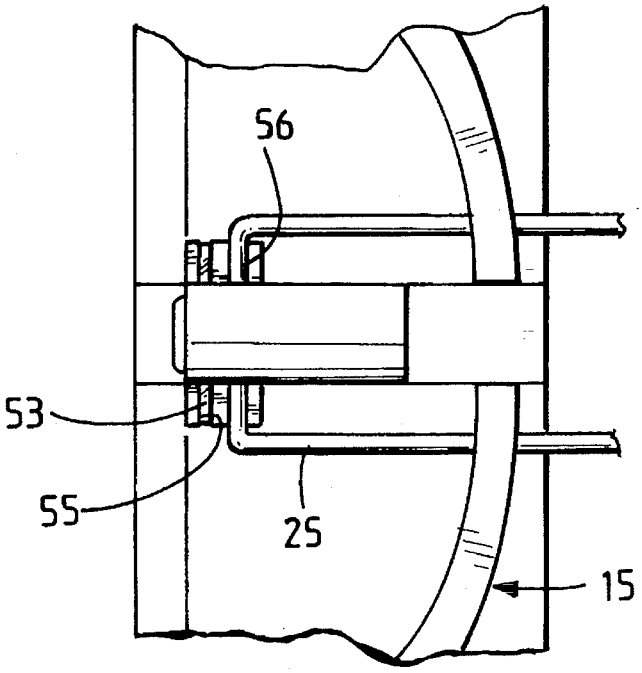
FIG. 12

SPONGE MOP

The present invention relates to a sponge mop comprising a mount connected to an upwardly and rearwardly sloping handle, the mount including at least one elongate support element adapted to receive a spongy layer, e.g. constituted by a sponge, fixed thereto by releasable means.

BACKGROUND OF THE INVENTION

Known sponge mops have sponge fixing means that are complicated and expensive. For example, such means may comprise two fixing heads secured to a semi-rigid plate glued to the sponge and suitable for being inserted in keyhole-shaped openings formed in the body of the support. The sponge is installed by inserting the fixing heads into the large portions of the keyhole-openings and by sliding the sponge towards the narrower portions of the openings.

The need to manufacture a plate of semi-rigid material of the above-described type and to glue it onto the sponge increases the cost price of replacement sponges very considerably. This constitutes an excessive expense for housewives who need to replace worn sponges often.

Furthermore, it is common general knowledge that the volume of a sponge varies significantly depending on whether it is dry or wet. The volume of the sponge diminishes as it dries and takes up a highly shrunk state. In contrast, once the sponge has been moistened, its volume increases and the sponge takes up a maximally extended state. Known means for fixing sponges to a conventional sponge mop oppose this natural deformation process. This gives rise to major internal stresses when the sponge shrinks after it has been moist. Such stresses can give rise to tears within the structure of the sponge, thereby considerably accelerating the rate at which it wears.

This poses an additional problem to housewives who are constrained to exchange expensive sponges frequently.

OBJECTS AND SUMMARY OF THE INVENTION

An object of the present invention is therefore to provide fixing means that are simple and quick to use and that enable the cost price of sponges to be reduced while also increasing their lifetime.

Housewives find sponge mops particularly practical to use when means are provided for wringing out the sponge.

In this context, the present invention also relates to a sponge mop provided with the above-mentioned releasable fixing means, in which the mount includes an elongate support constituted by two lateral wings mounted to pivot about at least one front-and-back axis situated at the inside ends of the wings, and including means for controlling the position of the lateral wings to move them between an in-line, mopping position and a wringing-out position in which the wings are pivoted towards each other.

For example, known control means of that kind comprise a quite bulky grip guided to move relative to the handle of the mop, with lateral branches of the pusher being capable, when displaced downwards, of pressing against the wings so as to move them towards each other by causing them to pivot about their axis. The wings can be brought back into the in-line, mopping position under drive from a resilient member, e.g. a spring.

Such means suffer from the drawback of being quite bulky and of increasing the structural weight of the sponge mop. Furthermore, the wings are driven by two different members, the grip and the spring, thereby increasing the risk of misfunction.

Thus another object of the present invention is to provide means for controlling the position of the wings, which means are of limited size and weight and are directly driven by a single control member, both when going towards the wringing-out position, and when returning to the mopping position.

More precisely, a first object of the invention is to propose fixing means that implement firstly at least two automatically-gripping fixing slides placed on the bottom face of the elongate support of the mop, and secondly one or more hooking slabs that are easy to manufacture and cheap, and that are secured to the top face of the sponge or of the spongy layer. The sponge is then fixed to the support easily by pressing said sponge against the bottom face of the support in such a manner that the automatically-gripping slides and the hooking slab(s) previously brought face to face cooperate with each other and hold the sponge in place.

When the sponge needs to be replaced, it is very easily removed from the support merely by being pulled off it.

The lifetime of the sponge is lengthened because it is mounted via automatically-gripping fixing slides in slideway-forming means provided on the bottom face of the support element and extending lengthwise relative to said element. Thus, when the sponge dries out, the in-line fixing slides received in one or more slideways move towards each other without opposing shrinkage of the sponge. In contrast, when the sponge is wet and returns to its maximum dimensions, the in-line slides move apart from each other to accompany such expansion. Although the wet sponge increases not only in length, but also in width, there is no need to provide slides having a degree of freedom in the sponge width direction. When the support is elongate in shape so as to be very considerably longer than it is wide, a sponge fitted to the support will expand on being moistened much more lengthwise than widthwise.

Nevertheless, it is advantageous for the displacement of the slides in the slideway-forming means to be limited at either end by abutments. Such abutments prevent the slides being wrongly positioned and they prevent them escaping from the elongate support.

Insofar as the sponges are generally delivered in a shape that corresponds substantially to their largest dimensions when wet, it is advantageous to provide resilient means that are suitable, in the absence of a sponge, for holding the fixing slides in their naturally spaced-apart position. Such resilient means may be constituted by springs, for example, and they further simplify the step of fixing the sponge on the support, since they avoid any need for prior adjustment of the positions of the fixing slides within the slideway-forming means.

On the sponge, the hooking slab is advantageously constituted by a loose-fiber plate of fiber material which is secured to the spongy material by gluing. Under such circumstances, the gripping members of the fixing slides are advantageously mushroom-shaped lugs whose heads are suitable for hooking to the fibers of the hooking slab.

In the description below, the "bottom" face of a component element of the sponge mop designates the face of said elements that is naturally situated close to the ground during mopping; the "top" face is clearly the opposite face thereof. The "front" face designates the face remote from the handle, and the "back" or "rear" face designates the face on the same side as the handle.

The above-mentioned fixing means for the sponge are advantageously fitted to a sponge mop that includes an elongate support element constituted by two lateral wings mounted to pivot about at least one front-and-back axis. Such a sponge mop also includes means for controlling the position of the wings to move them between a mopping position and a wringing-out position.

A second object of the invention is to provide improved means for controlling the position of the wings.

These means comprise two guide slots or slideways each placed on the top face of a corresponding one of the two lateral wings, and two guide rods that are pivotally mounted about a horizontal axis which is perpendicular to the pivot axis of the lateral wings, and that have respective front portions which co-operate with the guide slots. The rear portions of the rods are connected to control means for causing them to pivot simultaneously. These control means advantageously include a hinge joint connected to a rod that extends substantially along the handle and to a grip that is designed to slide along the handle and that is hinged to said rod. The grip is small in size and may be considered as constituting a mere ring that surrounds the handle and that includes a housing behind the handle for receiving the above-mentioned control rod in hinged manner.

It will readily be understood that the fact of displacing the grip downwards along the handle causes the guide rods to pivot downwards by driving them via the control rod and the hinge joint. The front portion of each guide rod is placed over one of the wings and is offset a little outwardly from the pivot axis of the wing. Thus, when the guide rods are actuated by being pivoted downwards, they co-operate with the bottom faces of the respective guide slots so as to push the wings downwards and towards each other. The guide slots need to be disposed on the wings and at least obliquely relative to their pivot axes. For example, the guide slots may form circular arcs running from the rear faces of the wings and extending towards their front faces, each arc being centered substantially on the pivot axis of the corresponding guide rod.

Moving the grip in the opposite direction causes the guide rods to pivot upwards, thereby returning them to their initial positions. During this pivoting movement, the front portions of the rods co-operate with the top faces of the guide slots that face the top face of the wings, thereby returning the wings to the in-line, mopping position.

It can thus be seen that the position control means for the wings of the invention serve to provide full direct control of their motion both when moving them to the wringing-out position and when returning them to the mopping position.

In a particularly advantageous embodiment, the sponge mop includes a socket device for fixing the handle to the mount. Such a socket device makes it quick and easy to fit the handle to the mount of the sponge mop; in addition, it makes it possible to fit any handle to the mount, no special means being required on the end of the handle, and this constitutes an advantage should it ever be necessary to replace the handle.

By implementing both fixing means and clamping means, the socket device of the invention has the advantage of providing dual-action fixing that is particularly reliable.

The socket device comprises a first element secured to the mount and having a cavity that is designed to receive the handle. The cavity tapers downwards and is provided with fixing means that may be constituted, for example, by inside teeth. The outside wall of this first element extends upwards in the form of resilient clamping means, and it has a threaded portion.

The device also includes a second element constituted by a clamping ring threaded onto the handle. Towards its bottom end, the clamping ring has a tapped portion for co-operating with the threaded portion of the first element, which tapped portion is followed by a portion whose inside wall is in the form of a cone tapering upwardly and leading in to a portion of cylindrical section.

When the second end of the handle is disposed in the cavity of the first element, it is held by the fixing means in said cavity. The clamping ring is then screwed onto the first element, thereby causing its conical inside wall to co-operate with the resilient clamping means of said first element and urging them against the handle. Additional fixing of the handle to the mount is thus provided. The resilient clamping means are constituted by axially extending tongues suitable for being deformed radially so as to clamp onto the handle.

It is advantageous for the tongues to be suitable for being urged inwards so as to be capable of clamping onto a handle whose diameter is equal to the smallest diameter of the cavity in the first element. It will thus be understood that the socket device is capable of retaining handles having a diameter lying anywhere between a minimum value equal to the smallest diameter of the cavity and a maximum value that can be accepted by at least the top portion of the cavity of the first element having the fixing means.

In a particularly advantageous embodiment, the sponge mop is rockable, i.e. the first element of the socket device has a curve terminating in a front portion constituted by a stub axle for being pivotally mounted in a sleeve secured to the top of the mount of the sponge mop, and for being prevented from moving in translation relative thereto. The sleeve extends along the front-and-back middle axis of the mount, thereby enabling the stub axle to pivot about said axis. In this embodiment, a scraper is mounted on the end of the stub axle in a position that is slightly in front of the front face of the mount.

Thus, by rotating the handle so as to swing the stub axle round, it is possible to put either the spongy layer or else the scraper into contact with the ground. This means that the sponge mop can be used either for scarping or for mopping.

In an advantageous embodiment, the scraper can be removed from the remainder of the sponge mop. To this end, it is constituted by a pad secured to a support plate whose rear face is extended by a finger suitable for being engaged in jaws provided at the front end of the stub axle. The finger of the scraper and the jaws of the stub axle advantageously include complementary elements of a snap-fastening device. Advantageously, the scraper includes a removable pad provided with a rigid rear face that is secured by releasable fastening means to the support plate. The releasable fastening means are advantageously constituted by a projecting rail of dovetail profile slidably received in a groove of complementary shape. To prevent untimely disconnection of the pad, the rail and the groove include a first end where they abut and a second end including complementary elements of snap-fastening means.

In any embodiment of the sponge mop that includes the above-mentioned pivoting lateral wings, means are advantageously provided for defining the in-line, mopping position of the wings and for holding them in said position.

When the sleeve is provided, it is advantageously integral with a middle support that enables the above-specified means to be implemented.

To this end, the side faces of the middle support advantageously include abutment faces suitable for co-operating with the inside faces of the lateral wings so as to define the in-line position thereof.

It is also possible to provide a snap-fastening device having a first portion that is secured to the middle support and a complementary portion secured to the top face of each wing. In another embodiment of the snap-fastening device, use is made of the front portions of the guide rods to constitute the first snap-fastening member, and a hollow portion is formed on the surface of each wing suitable for releasably receiving said first snap-fastening member.

BRIEF DESCRIPTION OF THE DRAWINGS

Other characteristics and advantages of the invention appear more clearly on reading the following description of an embodiment given by way of non-limiting example. The description refers to the accompanying drawings, in which:

FIG. 11 is a section on a larger scale taken on line XI—XI of FIG. 1;

FIG. 12 is plan view seen along arrow XII of FIG. 11;

MORE DETAILED DESCRIPTION

Figure 1:
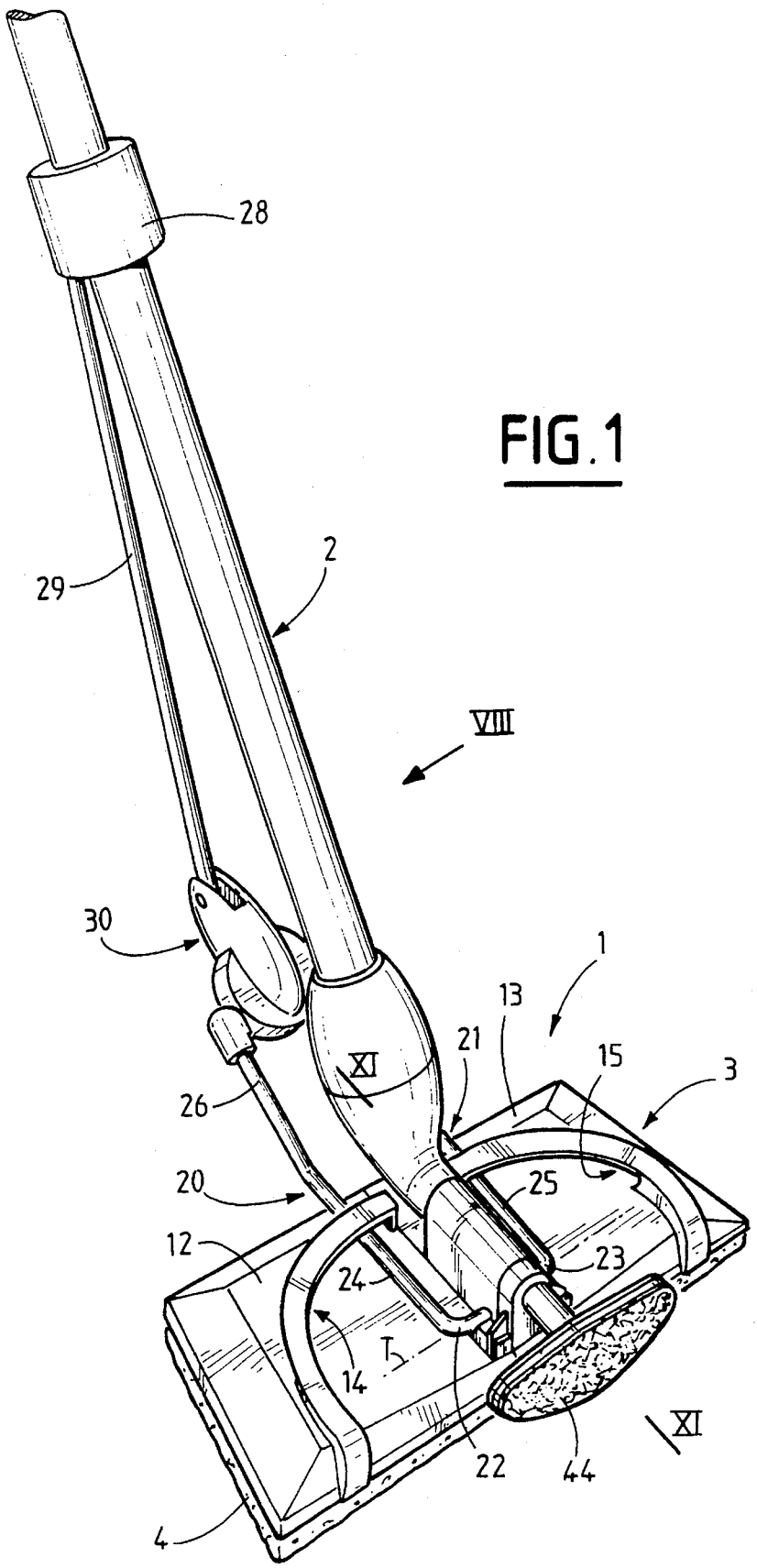
FIG. 1 is a perspective view of the sponge mop in the mopping position.

FIG. 1 shows a sponge mop comprising a mount 1 connected to an upwardly and rearwardly sloping handle 2. The mount 1 includes at least one elongate support element 3 adapted to receive a spongy layer 4 fixed by releasable means. For example, the spongy layer may be constituted by a sponge.

Figure 3:
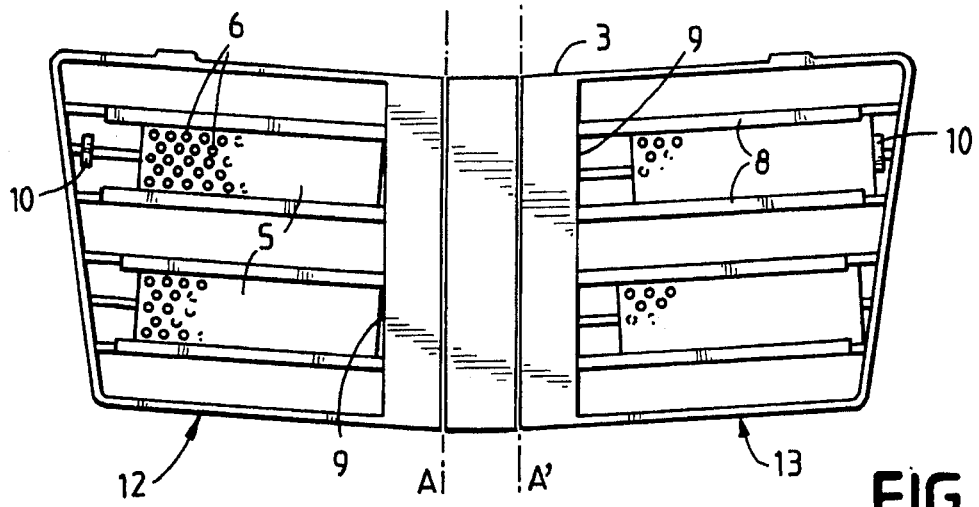
FIG. 3 is a view of the support on its own as seen from beneath.
Figure 4:
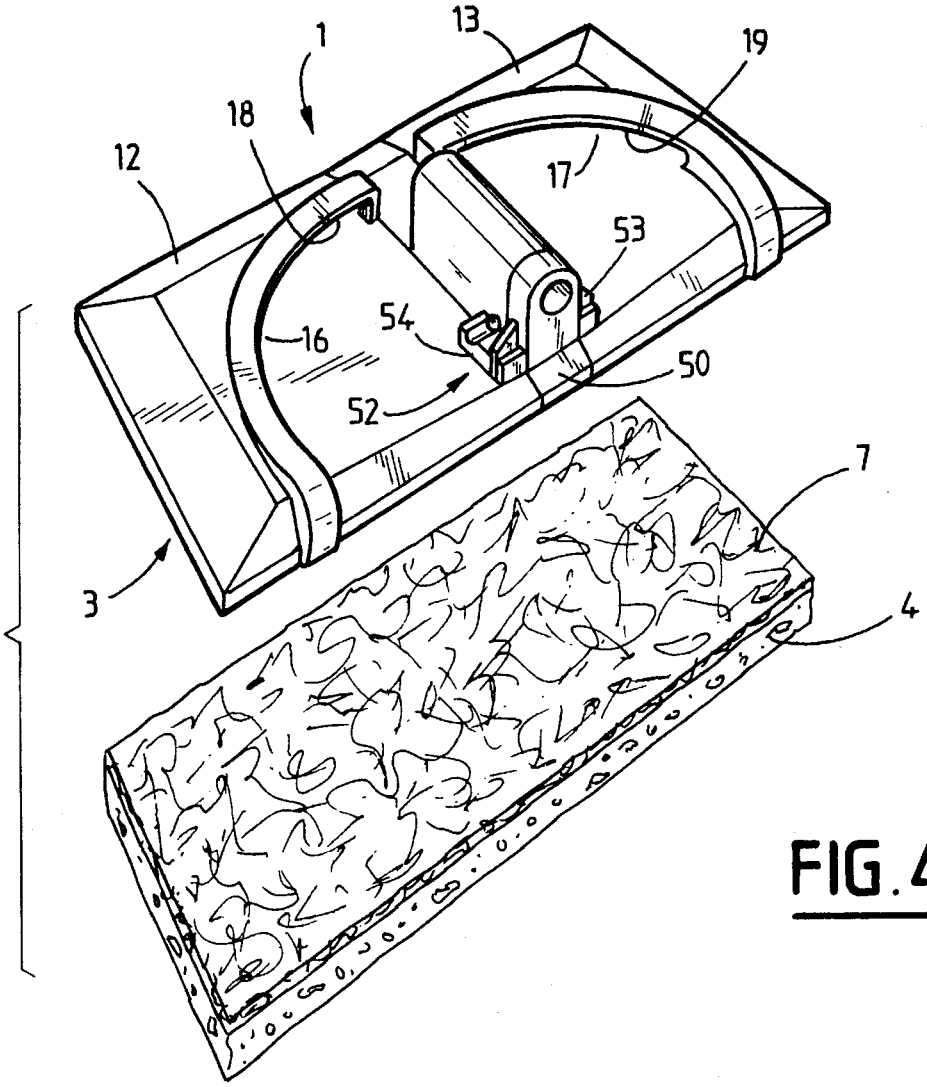
FIG. 4 is a perspective view showing the support and a sponge that are not connected together.
Figure 5:
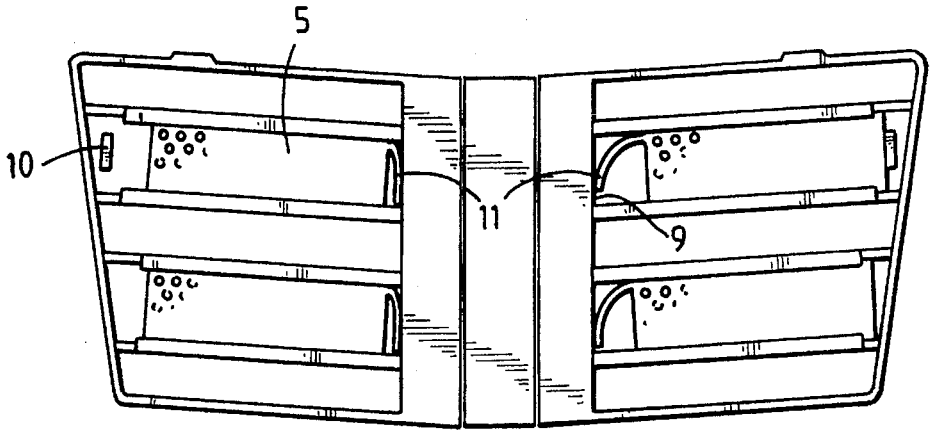
FIG. 5 is a bottom view of another embodiment of the support.

In accordance with the invention, and as shown in FIGS. 3 to 6, the releasable means for fixing the sponge are in two portions. They are constituted firstly by at least two fixing slides 5 secured to the support element 3 and having bottom faces provided with gripping lugs, and secondly by at least one hooking slab 7 secured to the top face of the sponge 4 and facing the fixing slides. The gripping lugs 6 are suitable for engaging in said hooking slab 7 in releasable manner. As can be seen in FIGS. 3 and 5, the fixing slides 5 extend lengthwise relative to the support element 3. They are slidably mounted in slideway-forming means 8 provided on the bottom face of the support element 3. These slideway-forming means naturally extend lengthwise relative to the support element 3. Thus, the fixing slides 5 are capable of moving towards each other to accompany sponge shrinkage and away from each other to accompany sponge expansion.

FIGS. 3 and 5 show an embodiment in which there are four fixing slides. In this case the slides capable of moving towards each other or away from each other depending on the shape of the sponge are naturally slides which are in alignment with each other. In FIGS. 3 and 5, the two slides on the left are shown in the shrunk position of the sponge, i.e. they are closer to the middle of the support. Conversely, the fixing slides shown to the right in the figures are in the expanded position of the sponge, i.e. they are further away from the middle of the support element and they are close to an end thereof.

As also shown in FIGS. 3 and 5, abutments are advantageously provided at either end of the fixing slides 5. Thus, the stroke of each fixing slide within the slideway-forming means 8 is limited at one end by a first abutment 9 placed towards the inside of the support element 3, and at a second end by a second abutment 10 placed towards the outside of said support element 3. As can be seen in the figures, the inside abutment 9 may be implemented merely by a face of the support element 3 that projects slightly and that extends perpendicularly to the slideways 8. The outside abutments are formed by projections situated close to the outside of the support element.

As shown in FIG. 5, the fixing slides 5 are advantageously associated with resilient means 11 designed to hold them in a natural separation position. In the embodiment shown, the resilient means 11 associated with each fixing slide 5 are constituted by an extension therefrom forming a spring at the inside end of each slide. The spring comes into abutment against the first abutment 9 in order to urge the fixing slide 5 into a position remote from the first abutment. This is shown in the righthand portion of FIG. 5. On the lefthand portion of that figure, the springs 11 are compressed because of shrinkage of the sponge (not shown).

Other embodiments of the resilient means may be provided. For example, it would be possible to associate a return spring with the outside end of each fixing slide.

Figure 6:
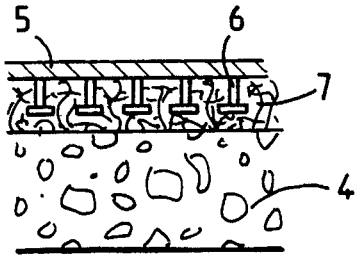
FIG. 6 is a section view showing a detail of how the sponge is fixed.

FIG. 6 shows a detail of the hooking between the fixing slides and the spongy layer in a preferred embodiment of the invention. In this figure, the lugs 6 of the fixing slides 5 are constituted by mushroom-shaped projections formed on the bottom faces of the slides. The hooking slab 7 of the sponge 4 is constituted by a loose-fiber slab of fiber material glued to the top face of the sponge. The mushroom-shaped heads of the gripping lugs 6 are suitable for hooking themselves to the fibers in the hooking plate 7 to fix the sponge to the mount. The heads are also capable of coming unhooked from the fibers when removing the sponge 4.

Figure 2:
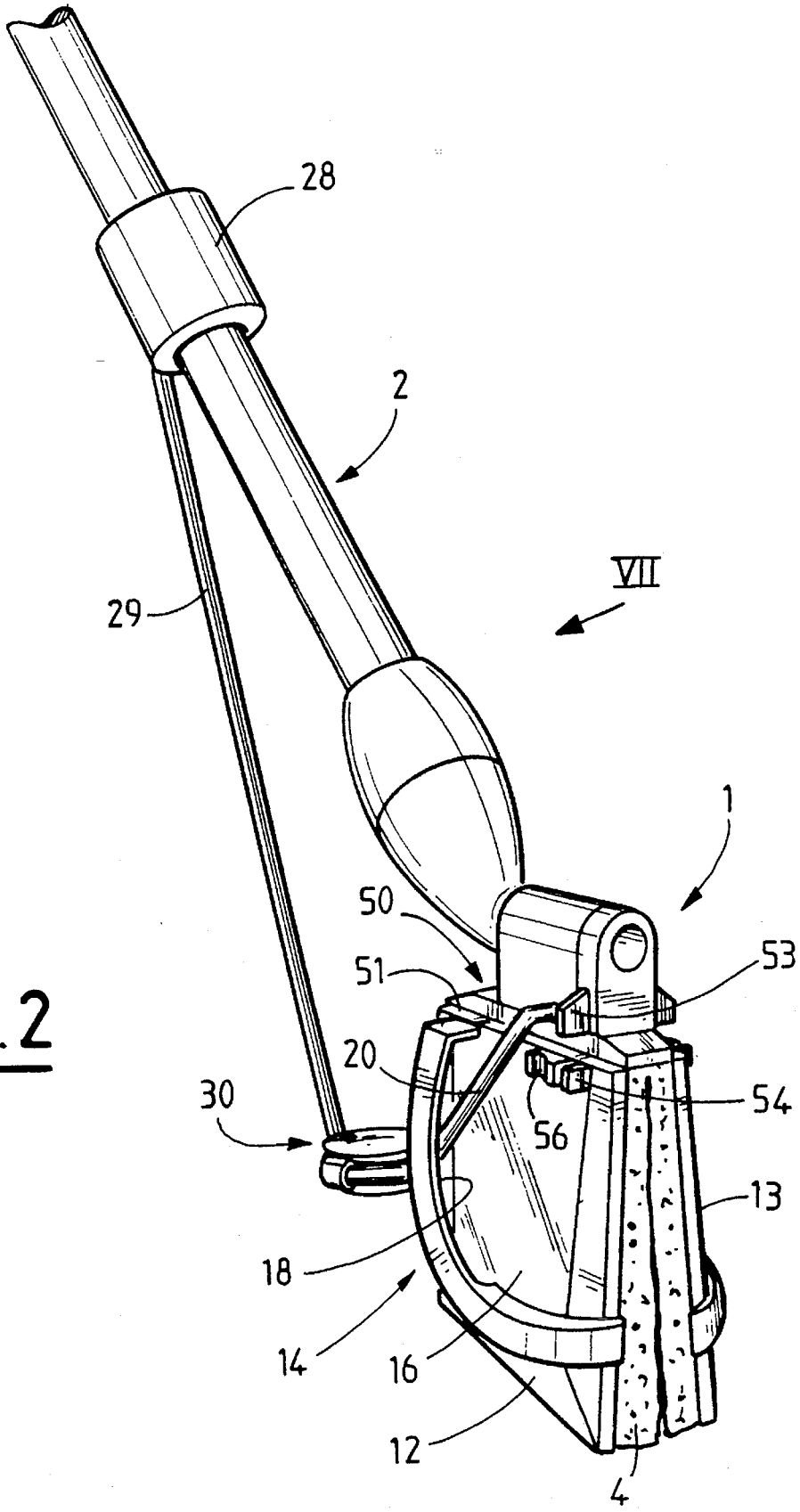
FIG. 2 is a perspective view of the same sponge mop in the wringing-out position.
Figure 7:
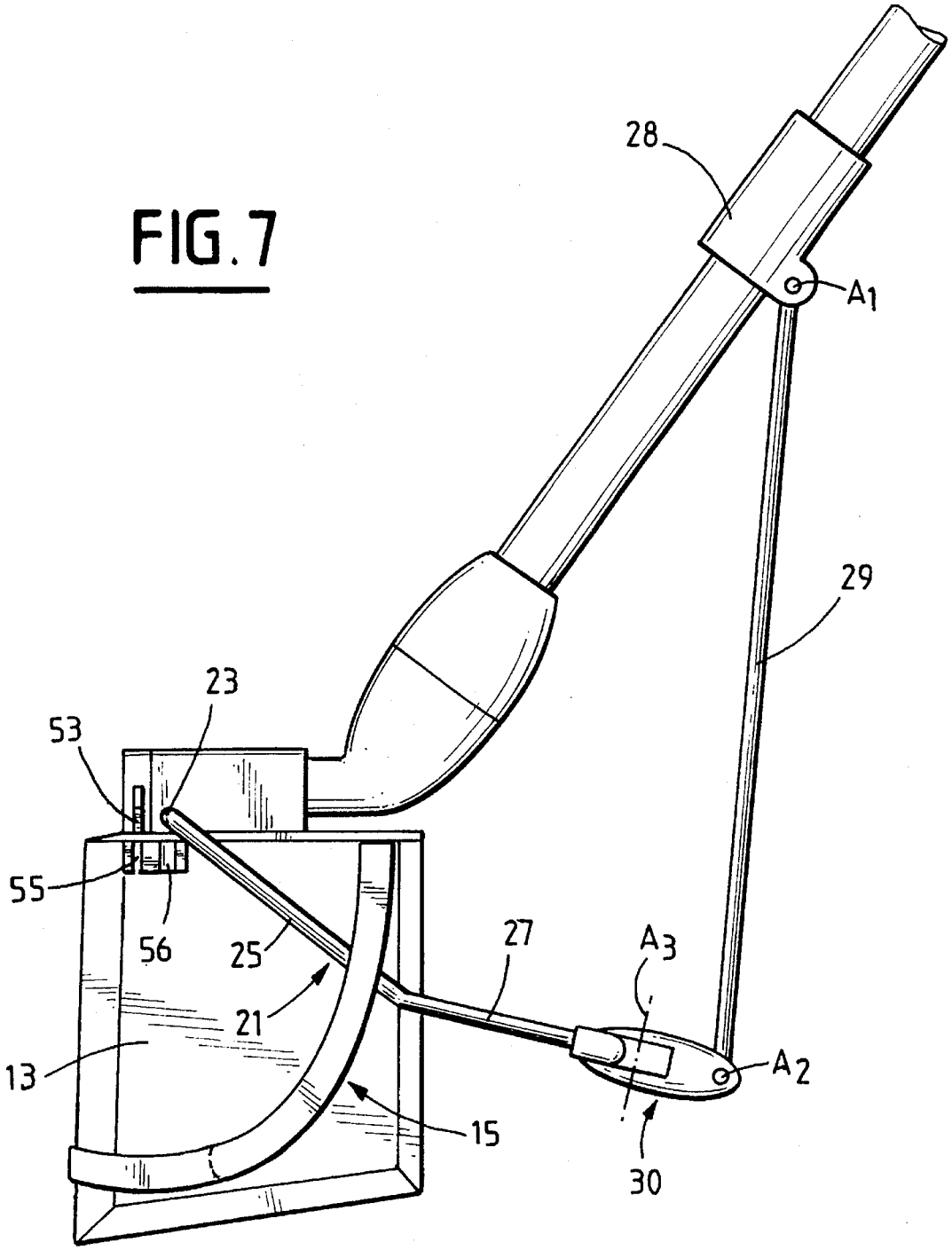
FIG. 7 is a view along arrow VII of FIG. 2.

Another aspect of the sponge mop of the invention is now described with references 1, 2, 7, and 8. In these figures, the elongate support element 3 is made up of two lateral wings 12 and 13 pivotally mounted about at least one front-and-back axis A, A'. The two wings can be mounted to pivot about the same front-and-back axis if their inside ends are joined together. However, in the embodiment shown, as can be seen in FIG. 3, the pivot axes A and A' of the lateral wings 12 and 13 are parallel and situated at the inside ends of respective wings. In this embodiment, the sponge mop includes means for controlling the position of the lateral wings 12 and 13 between a mopping position and a wringing-out position. These means are suitable for bringing the lateral wings 12 and 13 into a common horizontal plane in the mopping position, and for pivoting them towards each other as shown in FIGS. 2 and 7 so as to take up a wringing-out position in which the sponge is compressed.

Figure 8:
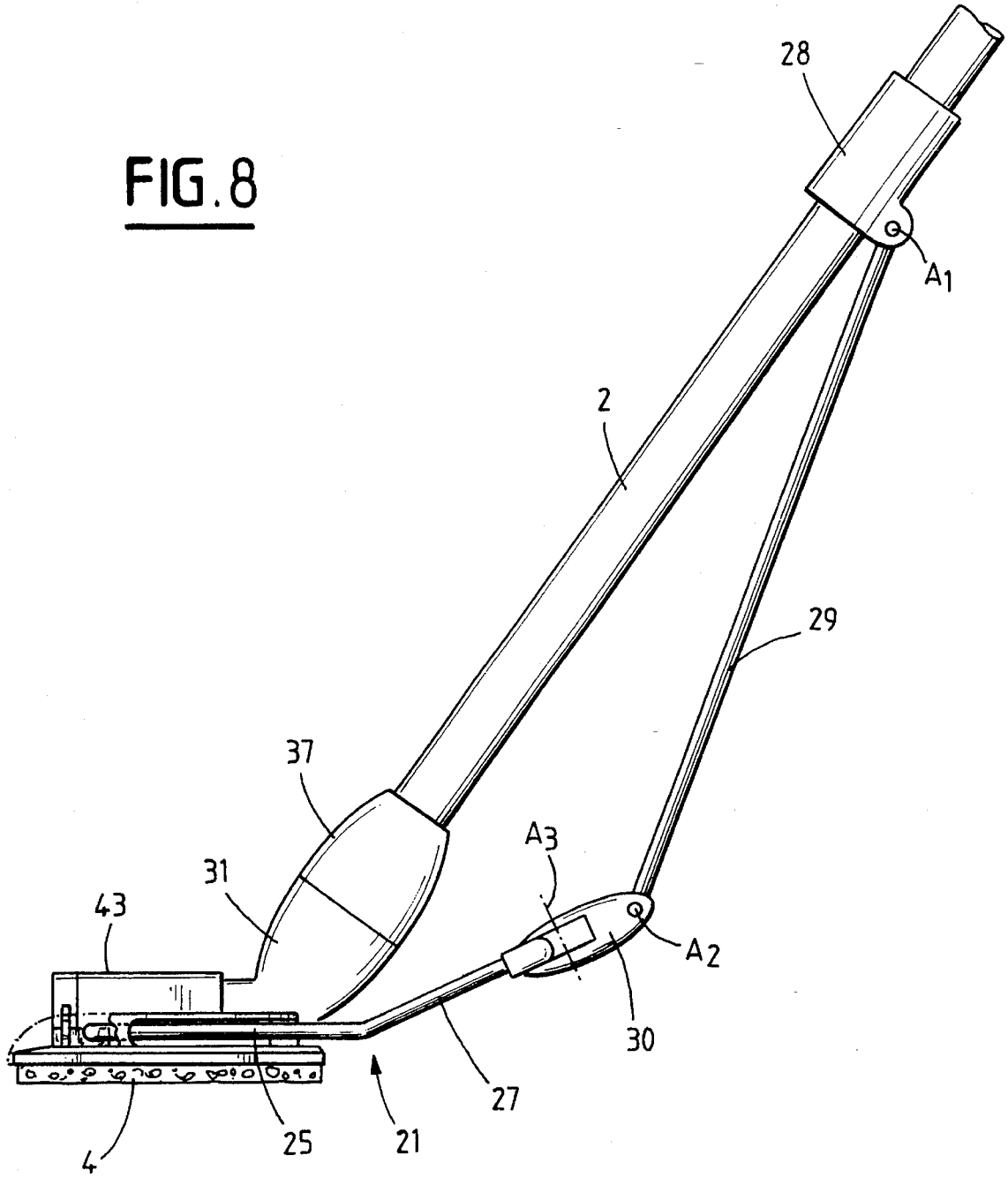
FIG. 8 is a view along arrow VIII of FIG. 1.

A preferred embodiment of the means for controlling the position of the lateral wings is described below. These means comprise two guide slots 14 and 15 placed on the top face of respective lateral wings 12 and 13. These two guide slots extend at least obliquely relative to the pivot axis of the corresponding lateral wing, and preferably starting from a rear portion of the wing. Each of the two slots 14 and 15 has a bottom face 16, 17 formed on the surface of the corresponding lateral wing 12 or 13, and a top face 18, 19 situated to face the bottom face. The means for controlling the position of the lateral wings also include two guide rods 20 and 21 each overlying a corresponding lateral wing and offset a little from the corresponding pivot axis A or A'. Each of these guide rods 20, 21 has a front end 22 or 23, a front portion 24 or 25, a rear portion 26 and 27, and a rear end. The front ends 22 and 23 are pivotally mounted about a horizontal axis T. This axis T is perpendicular to the front-and-back pivot axes of the wings and is situated towards the front of the mount 1. The front portions 24 and 25 of the two rods 20 and 21 are mutually parallel and each lies over the top face of the corresponding lateral wing. In the mopping position, as shown in FIGS. 1 and 8, these front portions of the rods are parallel to the front-and-back pivot axes of the wings. The rear portions 26 and 27 of the rods extend rearwardly from the front portions of the rods beyond the rear face of the mount 1.

The means for controlling the position of the lateral wings 12 and 13 include means for causing the guide rods 20 and 21 to pivot simultaneously. The changes between FIG. 1 and FIG. 2 and between FIG. 8 and FIG. 7 shows how these means operate. They are suitable for causing the guide rods 20 and 21 to pivot downwards. During this pivot movement, the front portions 24 and 25 of the guide rods press against the bottom faces 16 and 17 of the two guide slots 14 and 15. This has the effect of moving the lateral wings 12 and 13 towards each other so as to bring them to their wringing-out position. In contrast, in order to return the lateral wings from their wringing-out position to their mopping position, the means for causing the guide rods to pivot are also capable of causing these rods to pivot upwards. During this upward pivot movement, the rods act on the top faces 18 and 19 of the two guide slots 14 and 15. This has the effect of returning the two lateral wings to their position of alignment in a horizontal plane.

The effectiveness of the co-operation between the guide rods and the guide slots is linked to the fact that these slots are not parallel to the front-and-back pivot axes of the lateral wings and have at least one portion that is situated behind the pivot axis of the guide rods. In the figures given by way of example, the guide slots are in the form of circular arcs extending from the inside end of the rear face of each lateral wing and centered on the pivot axis of the guide rods. Other suitable shapes could be provided for the guide slot.

In a particularly advantageous embodiment, the means for causing the two guide rods 20 and 21 to pivot simultaneously comprise a grip 28, a control rod 29, and a hinge joint 30. As can be seen in the figures, the grip 28 is constituted, for example, by a ring mounted on the handle 2, it is guided along the handle, and it is connected to the top end of the control rod 29. The side views of FIGS. 7 and 8 show that the connection between the grip 28 and the rod 29 takes place about a hinge axis $A_1$. This axis $A_1$ is horizontal and perpendicular to the handle 2 of the sponge mop. The hinge joint 30 has two mutually perpendicular hinges. It comprises a top portion which is connected to the bottom end of the control rod 29 about a first hinge axis $A_2$. This axis is parallel to the hinge axis $A_1$ at the top end of the rod 29. The hinge joint 30 also includes a bottom portion which is pivotally mounted relative to its top portion about a second hinge axis $A_3$. As can be seen in the figures, this axis is directed substantially downwards and is perpendicular to the first hinge axis $A_2$ of the joint. The bottom portion of the hinge joint 30 receives the rear ends of the two guide rods 20 and 21 on opposite sides of the second hinge axis $A_3$.

In order to cause the guide rods to pivot downwards, the grip 28 is suitable for being pushed towards the bottom portion of the handle 2 of the sponge mop. Thus, the control rod 29 is pushed downwards, and via the hinge joint 30, this has the effect of causing the guide rods to pivot downwards about their pivot axis T. In contrast, in order to cause the guide rods 20 and 21 to pivot upwards, the grip 28 can be moved back towards the top end of the handle 2 of the sponge mop in order to pull the control rod 29 upwards. Then, via the hinge joint 30, the guide robs 20 and 21 are caused to pivot upwards.

As shown in the figures, the rear portions 26 and 27 of the guide rods 20 and 21 advantageously slope upwards so as to limit the rearwards extent of the means for controlling the position of the lateral wings 12 and 13.

The pivot axis T of the guide rods 20 and 21 is advantageously embodied by the front ends of said rods being curved inwards. It is also advantageous to provide means for limiting the upwards displacement of the grip along the handle, so that the topmost position of the grip 28 corresponds to holding the two side wings 12 and 13 in the common plane of the mopping position. Such means may be constituted by an abutment projecting from the handle and designed to co-operate with the grip for the above-specified purpose. It is also possible for such means to be constituted by abutment faces formed on the lateral wings themselves.

Figure 9:
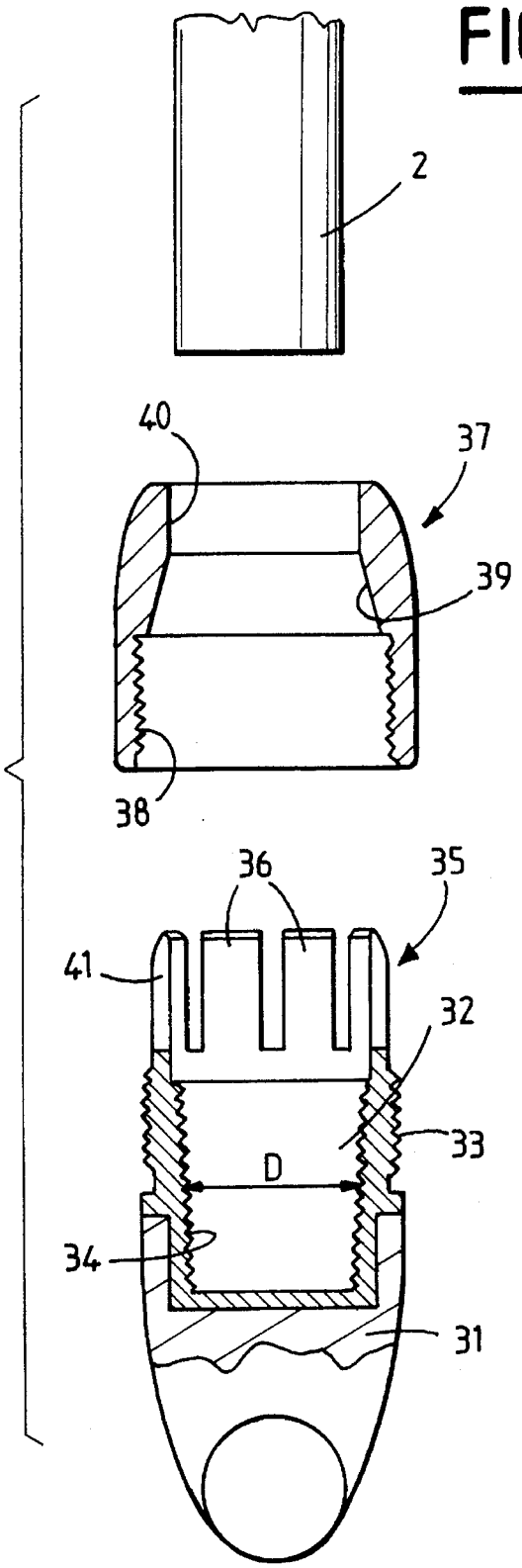
FIG. 9 shows the socket device in the non-assembled state.

A socket device suitable for fitting to a sponge mop in accordance with any of the above-mentioned embodiments is described below with reference to FIGS. 9 and 10. This socket device is designed to fix the handle 2 to the mount 1. It comprises a first element 31 secured to the mount 1 and having a top portion that is open to a cavity 32 designed to receive the handle 2, and a middle portion provided with an outside thread 33. As can be seen in the figures, at least a fraction of the cavity 32 is in the form of a cone whose diameter D tapers downwards; this cavity and more specifically the above-mentioned portion thereof is also provided with handle-fixing means 34. The top portion of the first element 31 presents clamping means 35 constituted by resilient tongues 36 that extend axially and that have free top ends. These tongues 36 are thus suitable for being urged resiliently inwards so as to clamp onto the handle 2.

The socket device also includes a second element 37 constituted by a clamping ring. This clamping ring 37 has a tapped bottom portion 38 of larger diameter for co-operating with the outside thread 33 of the middle portion of the first element 31. The clamping ring also has a middle portion whose inside wall 39 is in the form of a cone tapering upwards from the larger diameter bottom portion 38. This conical portion leads to a top portion provided with a cylindrical bore 40 whose inside diameter is equal to the smallest diameter of the internal conical wall 39. In order to fix the handle, the smallest diameter of the clamping ring must be not less than the outside diameter of the handle 2.

Figure 10:
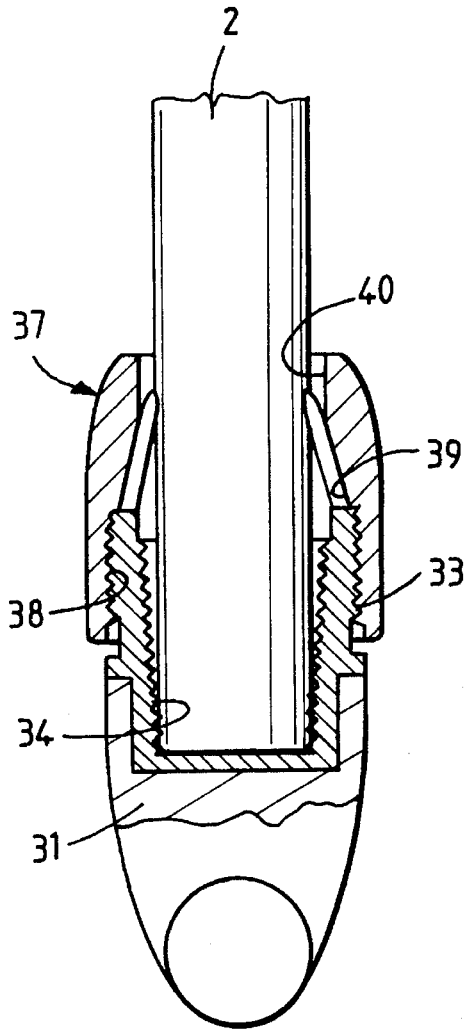
FIG. 10 shows the socket device in the assembled state.

As shown in FIG. 10, the clamping ring 37 is designed to be screwed around the handle 2 onto the first element 31 which is secured to the mount. As a result, the conical inside wall 39 of the middle portion of the clamping ring 37 co-operates with the resilient tongues 36 of the first element 31 and urges them inwards against the handle 2. Thus, it can be seen in FIG. 10 that the handle 2 is fixed to the mount firstly by the fixing means 34 inside the cavity 32 of the first element 31, and secondly by the ends of the resilient tongues 36 urged against said handle by the clamping ring 37.

In order to facilitate co-operation between the tongues 36 and the conical inside wall 39 of the clamping ring 37, it is advantageous for the free ends of the tongues 36 to present a conical outside wall.

The tongues are advantageously suitable for being pushed inwards at least until their ends define an opening whose diameter is equal to the smallest diameter of the cavity 32 in the first element 31.

It is advantageous for the inclination and the axial length of the conical inside wall 39 of the middle portion of the clamping ring 37, and for the length of the tongues 36 to be such that when said clamping ring 37 is screwed onto the first element 31, the ends of the tongues 36 are capable of clamping onto a handle 2 of a diameter that corresponds to the smallest diameter of the cavity 32 in the first element 31. The socket device of the invention thus makes it possible to fix the mop to a handle having any diameter between the smallest diameter of the cavity 32 in the first element 31 and a larger diameter corresponding to the largest diameter of the portion of the cavity 32 which is provided with the fixing means 34.

These means 34 for fixing the handle 2 in the cavity 32 of the first element 31 of the socket device are advantageously constituted by teeth that project into the cavity 32.

In a particularly advantageous embodiment, shown in greater detail in FIGS. 11 and 12, the first element 31 of the socket device has an angled portion terminating at a front portion constituted by a stub axle 42. The angle $\alpha$ of the angled portion of the first element 31 of the socket device lies in the range 30° to 60°, and is preferably substantially equal to 45°. In this case, a sleeve 43 extending along the middle front-and-back axis M of the mount 1 and integrally formed with said mount is situated on the top thereof. The stub axle 42 is mounted to pivot about said middle front-and-back axis M and is prevented from moving in translation in the sleeve 43. In this embodiment, a scraper 44 (visible in particular in FIG. 1) is advantageously mounted on the end of the stub axle 42 and extends close to the front face of the mount 1. By rotating the handle 2 about its own axis so as to pivot the first element 31 of the socket device and swing round the middle front-and-back axis M, it is possible to put either the sponge 4 or else the scraper 44 into contact with the ground.

Figure 13:
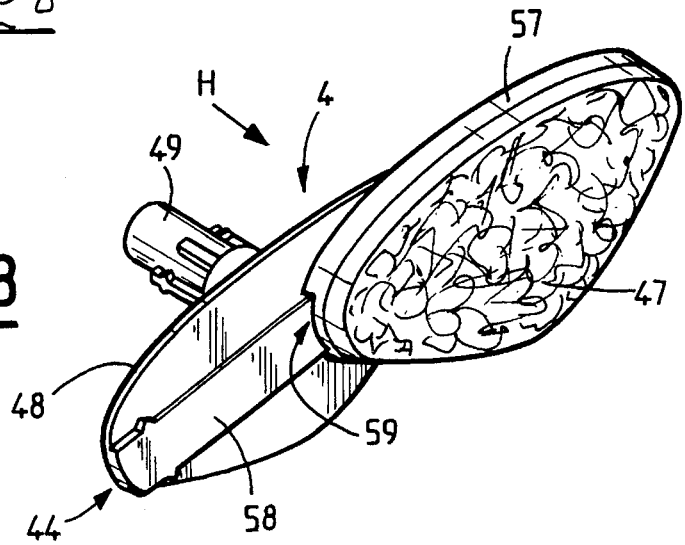
FIG. 13 is a perspective view of the partially-assembled scraper on its own.
Figure 14:
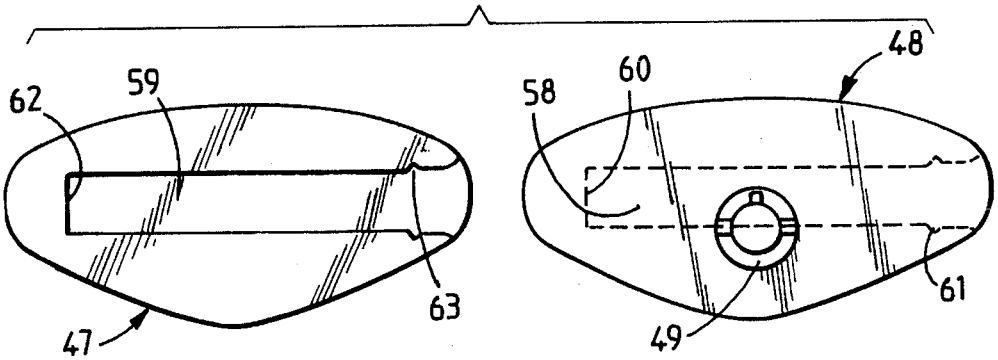
FIG. 14 is a view along arrow H of FIG. 13 showing the scraper in the unassembled condition.

A cap 64 may be placed around the sleeve and may establish contact between the sleeve and the angled front portion of the first element 31 of the socket device. In order to prevent it from moving in translation, the stub axle 42 of the first element 31 of the socket device advantageously has a shoulder 45 situated close to the angled portion of said first element, and a front end constituted by jaws that are resiliently deformable. The combined effect of the jaws 46 coming into abutment against the front face of the sleeve and of the shoulder coming into abutment against the rear face of the sleeve naturally prevents the stub axle 42 from moving in translation. When a cap 46 is provided, the abutment action of the jaws 46 is applied to the front face of the cap 64, and the abutment action of the shoulder 45 is applied against the rear face of the cap 64. The scraper 44 is mounted on the end of the stub axle 42 by means of a finger 49 that extends said scraper rearwards. More precisely, as shown in FIGS. 13 and 14, the scraper 44 includes a pad 47 secured to a support plate 48 that is integral with the finger 49 and that is suitable for being engaged between the jaws 46 constituting the front end of the stub axle 42. Snap-fastening means can then be provided at the end of the finger for the purpose of co-operating with the jaws of the stub axle.

When the sleeve 4 is present, the lateral wings 12 and 13 of the mount 1 are advantageously pivotally mounted on said mount via a middle support 50 that is integral with the sleeve 43. Under such circumstances, the pivot axis A, A' of each of the lateral wings 12 and 13 is a front-and-back axis situated on a respective side of said middle support 50. As shown in FIG. 2, the lateral faces 51 of the middle support 50 advantageously include abutment faces for defining the aligned, mopping position of the lateral wings 12 and 13.

In this figure, it can also be seen that each lateral wing 12, 13 is advantageously held by a snap-fastening device 52. The snap-fastening device 52 comprises a first element 53 secured to the middle support 50 and a second element 54 secured to the top face of the corresponding lateral wing 12 or 13. When the cap 64 is present, the first element of the snap-fastening device may be secured directly thereto. As shown in particular in FIG. 1, the first and second elements 53 and 54 of the snap-fastening devices for each lateral wing 12 and 13 are designed to co-operate with each other in such a manner as to hold the lateral wings in the mopping position. The first element of each snap-fastening device 52 advantageously comprises a tongue 53 secured to the front portion of the sleeve. Under such circumstances, the second element of each snap-fastening device comprises a slot 55 which advantageously has small internal projections. The tongue 53 is then capable of being inserted, at least in part, into the slots 55 and of being releasably retained by the internal projections therein.

An alternative or additional way of making the snap-fastening devices uses the front ends 22 and 23 of the guide rods 20 and 21. To this end, the said front ends advantageously curve inwards,.with each constituting at least a portion of the first element of each snap-fastening device. As can be seen in FIG. 2, the second element 54 of each snap-fastening device may include a hollow portion 56 designed to receive in releasable manner the corresponding curved-in front end 22 or 23 of the guide rods 20 and 21.

A particularly advantageous embodiment of the scraper 44 in accordance with the invention is described below. In this embodiment, the pad 47 is constituted by a scraping layer secured by its rear face to a rigid backing plate 57. The backing plate 57 and the support plate 48 are then provided with complementary releasable fastening means. As can be seen in FIGS. 13 and 14, these releasable fastening means are advantageously constituted firstly by a projecting rail 58 of dovetail profile provided on the front face of the support plate 48, and secondly by a groove 59 of complementary profile mounted on the rear face of the backing plate 57.

In order to avoid any untimely disconnection of the pad 47 from the support plate 48, the rail 58 projecting from the front face of said support plate 48 advantageously has a first abutment face 60 situated at one end and a first portion 61 of a snap-fastening system situated near its opposite end. The groove 59 in the rear face of the backing plate 57 then has a second abutment face 62 situated at one end and a second portion 63 of the same snap-fastening system situated towards its opposite end. It will readily be understood that the pad 47 is mounted on the support plate 48 by causing the groove 59 to slide on the projecting rail 58. This sliding is continued until the first and second abutment faces 60 and 62 and also the first and second portions of the snap-fastening system 61, 63 co-operate mutually so as to hold the pad locked in position on the support plate. Naturally, it is possible to provide an equivalent system comprising a rail that projects from the rear face of the backing plate secured to the pad 47 and a complementary grooved formed in the front face of the support plate 48.

Various modifications may be made to the sponge mop as described above without going beyond the ambit of the invention.

We claim:

1. A sponge mop comprising a mount connected to an upwardly and rearwardly sloping handle, said mount including at least one support element adapted to receive a spongy layer fixed thereto by releasable fixing means, said releasable fixing means comprising at least two fixing slides secured to said at least one support element, each fixing slide having a bottom face provided with gripping lugs, said releasable fixing means further comprising at least one hooking slab secured to a top face of the spongy layer and facing said at least two fixing slides, said gripping lugs being suitable for hooking to said at least one hooking slab in releasable manner; and each fixing slide is slidably mounted in slideway-forming means provided on a bottom face of said at least one support element and extending lengthwise relative to said at least one support element in such a manner that said at least two fixing slides are suitable for moving towards each other to accompany shrinking of the spongy layer and for moving away from each other to accompany expansion of said spongy layer.

2. A sponge mop according to claim 1, wherein a stroke of each fixing slide in the slideway-forming means is limited by a first abutment placed towards an inside of the at least one support element and by a second abutment placed towards an outside of said at least one support element.

3. A sponge mop according to claim 1, wherein each fixing slide is associated with resilient means designed to urge the fixing slides away from each other.

4. A sponge mop according to claim 3, wherein said resilient means associated with each fixing slide comprise respective spring-forming extensions at inside ends of each fixing slide, each of said spring-forming extensions coming into abutment against a corresponding first abutment in order to urge its fixing slide towards a position away from said first abutment.

5. A sponge mop according to claim 1, wherein:

the gripping lugs of the fixing slides comprise mushroom-shaped projections formed on the bottom faces of the fixing slides;

the said at least one hooking slab of the spongy layer comprises a loose-fiber slab of fiber material glued to the top face of said spongy layer; and head portions of said mushroom-shaped gripping lugs are suitable for hooking to the fibers of said at least one hooking slab to fix the spongy layer to the mount, and for being unhooked from said fibers when removing the spongy layer.

6. A sponge mop according to claim 1, wherein:

said at least one support element comprises two lateral wings pivotally mounted about at least one front-and-back axis; and the sponge mop includes means for controlling the position of said lateral wings and capable of bringing said lateral wings into a common plane in a mopping position, and of causing said lateral wings to pivot towards each other into a wringing-out position in which the spongy layer is compressed.

7. A sponge mop according to claim 6, wherein the means for controlling the position of the lateral wings comprise:

two guide slots each located on a respective top face of the two lateral wings and extending at least obliquely relative to said at least one front-and-back axis, each of said guide slots having a bottom face formed on the surface of the corresponding lateral wing, and a top face situated facing said bottom face formed on the surface of the corresponding lateral wing;

two guide rods each situated over a corresponding lateral wing and offset from said at least one pivot axis, each of said guide rods having a front end, a front portion, a rear portion, and a rear end, said front ends being pivotally mounted about an axis extending perpendicularly to said at least one front-and-back axis and being situated towards a front of the mount, said front portions being mutually parallel and being situated over the top faces of the corresponding lateral wings, and being parallel to said at least one front-and-back axis in the mopping position, said rear portions extending from said front portions rearwards beyond rear faces of the mount; and means for causing the guide rods to pivot simultaneously and suitable for causing said guide rods to pivot downwards, thereby pressing the guide rods against the corresponding bottom faces of the two guide slots while urging the lateral wings towards each other, and, starting from said wringing-out position, suitable for causing said guide rods to pivot upwards, thereby causing the guide rods to act against the corresponding top faces of the two guide slots, thereby returning the two lateral wings towards their alignment position in the common plane.

8. A sponge mop according to claim 7, wherein: the means for causing the two guide rods to pivot simultaneously comprise a grip, a control rod, and a hinge joint, said grip being guided along the handle of the sponge mop and receiving a top end of said control rod via a top hinge axis that is perpendicular to the handle, the hinge joint including a top portion having a bottom end of the control rod connected thereto via a first joint hinge axis parallel to said top hinge axis, and a bottom portion pivotally mounted to said top portion about a second joint hinge axis extending substantially downwards and perpendicular to said first joint hinge axis, said bottom portion of the hinge joint receiving the rear ends of each of the two guide rods on opposite sides of said second joint hinge axis;

the grip is suitable for being pushed down the handle of the sponge mop in order to urge the control rod downwards, and in order to act via the hinge joint to cause the guide rods to pivot downwards; and the grip is suitable for being returned up the handle of the sponge mop in order to return the control rod upwards and to act via the hinge joint to cause the guide rods to pivot upwards.

9. A sponge mop according to claim 7, wherein the rear portions of the guide rods slope upwards to limit the rearwards extent of the means for controlling the position of the lateral wings.

10. A sponge mop according to claim 8, wherein the pivot axis of the guide rods is embodied by the front ends of said rods being curved inwards.

11. A sponge mop according to claim 8, also including means for limiting the displacement of the grip towards the top of the handle so that the topmost position of said grip corresponds to the two lateral wings being held in the common plane in the mopping position.

12. A sponge mop according to claim 7, wherein:

the front ends of the guide rods of the means for controlling the position of the lateral wings curve inwards, each include at least a portion of a first element of a snap-fastening device; and a second element of the snap-fastening device includes a hollow portion designed to receive in releasable manner said curved front end of each guide rod.

13. A sponge mop according to claim 1, further including a socket device for fixing the handle to the mount, said socket handle-fixing device comprising a first element secured to the mount and having a top portion that is open to a cavity designed to receive the handle, and a middle portion provided with an outside thread, at least a fraction of said cavity having a downwardly-tapering conical shape and being provided with handle-fixing means, the top portion of said first element having resilient clamping means constituted by axially-directed resilient tongues whose top ends are free so that the tongues are suitable for being pushed radially inwards, the socket device further comprising a second element including a clamping ring having a larger-diameter tapered bottom portion designed for co-operating with the outside threads of the middle portion of the first element, a middle portion having an upwardly tapering conically-shaped inside wall running from said larger-diameter bottom portion, and a top portion provided with a cylindrical bore of diameter equal to the smallest diameter of the conical inside wall of said middle portion, said smallest diameter being not less than the outside diameter of the handle, said clamping ring being designed to be disposed around the handle and screwed onto the first element to cause said conical inside wall of the middle portion of said clamping ring to co-operate with said resilient tongues of the first element to urge them inwards against the handle.

14. A sponge mop according to claim 13, wherein the top ends of the tongues present a conical outside wall suitable for co-operating with the conical inside wall of the middle portion of the clamping ring.

15. A sponge mop according to claim 13, wherein the tongues are suitable for being urged inwards at least until their ends define an opening of diameter equal to the smallest diameter of the cavity of the first element.

16. A sponge mop according to claim 13, wherein the slope and the axial extent of the conical inside wall of the middle portion of the clamping ring and the length of the tongues are such that when said clamping ring is screwed onto the first element, the ends of the tongues are capable of clamping against a handle of diameter corresponding to said smallest diameter of the cavity of the first element.

17. A sponge mop according to claim 13, wherein the means for fixing the handle in the cavity of the first element of the socket device comprise teeth.

18. A sponge mop according to claim 13, wherein:

the first element of the socket device has an angled portion terminating in a front portion including a stub axle;

a sleeve extending along an axis of the mount is integral with said mount and is situated on the top thereof, said stub axle being pivotally mounted about a front-and-back middle axis in said sleeve and being prevented from moving in translation relative thereto; and a scraper mounted at the end of the stub axle and extending close to a front face of the mount in such a manner that rotating the handle about its own axis causes the first element of the socket device to swing round said front-and-back middle axis, thereby making it possible to put either the spongy layer or the scraper into contact with the ground.

19. A sponge mop according to claim 18, wherein:

the stub axle of the first element of the socket device presents a shoulder situated close to the angled portion of said first element, and a front end comprising resiliently deformable jaws, said stub axle being prevented from moving in translation by the combined abutment action of said jaws against the front face of the sleeve and of said shoulder against a rear face of said sleeve; and the scraper includes a pad secured to a support plate integral with a finger suitable for being engaged between the jaws of the stub axle.

20. A sponge mop according to claim 18, wherein:

a cap is disposed on the mount to cover the sleeve;

the stub axle of the first element of the socket device has a shoulder situated close to the angled portion of said first element, and a front end comprising resiliently deformable jaws, said stub axle being prevented from moving in translation by the combined abutment action of said jaws against a front face of the cap and of said shoulder against a rear face of said cap; and the scraper includes a pad secured to a support plate integral with a finger suitable for being engaged between the jaws of the stub axle.

21. A sponge mop according to claim 18, wherein lateral wings of the mount are mounted to pivot on said mount via a middle support that is integral with the sleeve, the pivot axis of each lateral wing being an axis situated on a respective side of said middle support.

22. A sponge mop according to claim 21, wherein side faces of the middle support include abutment faces for defining an aligned, mopping position of the lateral wings.

23. A sponge mop according to claim 21, wherein each lateral wing further includes a snap-fastening device comprising a first element secured to the middle support and a second element secured to a top face of the lateral wings, said first and second elements of the snap-fastening devices of the lateral wings being suitable for co-operating with each other so as to hold said lateral wings in a mopping position.

24. A sponge mop according to claim 23, wherein:

the first element of each snap-fastening device comprises a tongue secured to the front portion of the sleeve; and the second element of each snap-fastening device comprises a slot having small internal projections, said tongue being suitable for being inserted at least in part in said slot and for being releasably retained therein by said internal projections.

25. A sponge mop according to claim 19, wherein:

the pad includes a scraping layer whose rear face is secured to a rigid backing plate; and the rigid backing plate and the support plate are provided with complementary releasable fastening means.

26. A sponge mop according to claim 25, wherein said releasable fastening means comprise a projecting rail having a dovetail profile and provided on a front face of the support plate and a groove having a complementary profile provided in a rear face of the backing plate.

27. A sponge mop according to claim 26, wherein:

the projecting rail on the front face of the support plate has a first abutment face situated at one end and a first portion of a snap-fastening system situated towards its opposite end;

the groove in the rear face of the backing plate has a second abutment face situated at one end and a second portion of said snap-fastening system situated towards its opposite end; and the pad is mounted on the support plate by causing the groove to slide over the projecting rail until said first and second abutment faces and said first and second portions of the snap-fastening system co-operate mutually so as to hold the pad locked in position on the support plate.

* * * * *